US006537619B2

(12) United States Patent
Johnson et al.

(10) Patent No.: US 6,537,619 B2
(45) Date of Patent: Mar. 25, 2003

(54) METHOD OF SALVAGING CASTINGS WITH DEFECTIVE CAST COOLING BUMPS

(75) Inventors: Robert Alan Johnson, Simpsonville, SC (US); Jon Conrad Schaeffer, Greenville, SC (US); Ching-Pang Lee, Cincinnati, OH (US); Nesim Abuaf, Lincoln City, OR (US)

(73) Assignee: General Electric Company, Schenectady, NY (US)

( * ) Notice: Subject to any disclaimer, the term of this patent is extended or adjusted under 35 U.S.C. 154(b) by 77 days.

(21) Appl. No.: 09/833,796

(22) Filed: Apr. 13, 2001

(65) Prior Publication Data

US 2002/0150672 A1 Oct. 17, 2002

(51) Int. Cl.[7] ..... C23C 4/08

(52) U.S. Cl. ..... 427/449; 427/456; 427/142; 427/140

(58) Field of Search ..... 427/449, 456, 427/142, 140, 446; 29/889.1

(56) References Cited

U.S. PATENT DOCUMENTS

| | | | | |
|---|---|---|---|---|
| 4,003,716 A | | 1/1977 | Steigelman et al. | |
| 4,116,723 A | | 9/1978 | Gell et al. | |
| 4,689,242 A | | 8/1987 | Pike | |
| 4,749,594 A | | 6/1988 | Malikowski et al. | |
| 4,878,953 A | * | 11/1989 | Saltzman et al. | 148/512 |
| 4,938,991 A | | 7/1990 | Bird | |
| 5,353,865 A | | 10/1994 | Adiutori et al. | |
| 5,399,313 A | | 3/1995 | Ross et al. | |
| 5,549,927 A | | 8/1996 | Cottone et al. | |
| 5,577,555 A | | 11/1996 | Hisajima et al. | |
| 5,590,711 A | | 1/1997 | Ishida et al. | |
| 5,783,318 A | * | 7/1998 | Biondo et al. | 148/512 |
| 6,254,997 B1 | * | 7/2001 | Rettig et al. | 428/553 |

FOREIGN PATENT DOCUMENTS

GB 2 320 929 A * 7/1998

OTHER PUBLICATIONS

"Pastes, Transfer Tapes, Preforms," Praxair product brochure (3 pages) (no date).

"Drills & Cutters," prints from website www.dremel.com, 3/99 (2 pages).

"Effects of Turbulator Profile and Spacing on Heat Transfer and Friction in a Channel," Taslim et al.; Journal of Thermophysics and Heat Transfer, vol. 8, No. 3, Jul.–Sep. 1994, pp. 555–562.

* cited by examiner

*Primary Examiner*—Katherine A. Bareford
(74) *Attorney, Agent, or Firm*—Nixon & Vanderhye

(57) ABSTRACT

Castings for gas turbine parts exposed on one side to a high-temperature fluid medium have cast-in bumps on an opposite cooling surface side to enhance heat transfer. Areas on the cooling surface having defectively cast bumps, i.e., missing or partially formed bumps during casting, are thermally sprayed to provide a metallic cooling enhancement surface layer to salvage the part.

12 Claims, 2 Drawing Sheets

METHOD OF SALVAGING CASTINGS WITH DEFECTIVE CAST COOLING BUMPS

BACKGROUND OF THE INVENTION

The present invention relates to a turbine casting having cast-in cooling bumps along a surface to provide improved heat transfer between a cooling medium and the opposite side of the casting. Particularly, the present invention relates to methods for salvaging castings with defective cast cooling bumps by applying a coating to areas of the defectively cast bumps to improve their heat transfer characteristics.

Various techniques have been devised to maintain the temperature of gas turbine components below critical levels. For example, a cooling medium such as coolant air from the turbine compressor or steam is often directed to the component along one or more component surfaces. Such flow is understood in the art as backside flow, where the cooling medium is directed at a surface of the component not directly exposed to high temperature gases of combustion. Enhanced heat transfer is also accomplished by providing cast cooling bumps along the backside flow surface. For example, cast cooling bumps may be provided in a gas turbine on the inside surfaces of the stage 1 and stage 2 nozzles. It will be appreciated that the outer surfaces of the nozzles are exposed to the hot gases and are subject to very high temperatures along the hot gas path exposed side thereof. A cooling medium such as steam or air flows through various cavities within the nozzles along the interior nozzle surfaces to provide backside cooling flow. The cast-in bumps on the interior surfaces of the nozzle have a generally hill-like shape and are spaced from one another to provide a coolant side surface area larger than that of the baseline smooth surface area.

In certain gas turbine components, for example, nozzles and shrouds, the cast-in cooling bumps are sometimes defective. By defective cast bumps is meant that one or more bumps are missing from the surface of the cast part or the bump is only partially formed. These defects occur as a result of manufacturing process limitations. When the parts are cast and inspected, defective areas can be identified and the parts are sometimes scrapped. This results in a significant financial loss. Accordingly, there is a need to provide a method for salvaging cast parts of a turbine that have defective cast cooling bumps.

BRIEF SUMMARY OF THE INVENTION

In accordance with a preferred embodiment of the present invention, there is provided methods of salvaging a casting having cast cooling bumps projecting from a surface thereof wherein one or more areas of that surface have defectively cast bumps manifested by one or more missing or partially cast bumps. To accomplish the foregoing, the surface area or areas manifested by one or more missing or partially cast bumps are first identified by visual inspection or thermography. Once identified, the area or areas are cleaned and the defective bumps removed, e.g., by grinding or grit blasting. Thus, partially formed bumps may be ground down to the surface area between the bumps, or the smooth area or areas with partially formed bumps may simply be roughened. After cleaning, cooling enhancement material is applied to the surface area(s) manifesting defectively cast bumps and the spaces between the defectively cast bumps. Preferably, a coating containing particles, e.g., metal particles, is applied to the defective area. For example, a metallic powder is set in intimate contact with the defective area and brazed thereto by an electric arc wire sprayed thermal process. The size of the metallic powder particles is selected to provide heat transfer enhancement on the local defective surface area. The alloy of the metallic powder particles is chosen to withstand the part operating conditions while providing a high thermal conductivity. The alloy must also withstand the part operating temperature while not diminishing other part properties, i.e., LCF. By applying the coating in the local area of the defectively cast bumps, the part can be salvaged and utilized, notwithstanding the lack of bumps or partial bump formation in one or more areas of the backside surface. It will be appreciated that this salvage or repair technique can be used on most or all of the gas turbine parts having cast bumps, such as shrouds, certain stator nozzles, buckets and the like, for enhancing heat transfer.

In a preferred embodiment according to the present invention, there is provided a method of salvaging a casting having cast cooling bumps projecting from a surface thereof wherein at least one area of the surface has defectively cast bumps manifested by one or more missing or partially cast bumps, comprising the steps of identifying the defectively cast area and thermally spraying a coating on the defectively cast area to form an overlying coated surface having a coated surface area in excess of the uncoated defective surface area to afford enhanced heat transfer across the casting relative to the heat transfer across the casting without applying the coating.

DETAILED DESCRIPTION OF THE INVENTION

Figure 1:
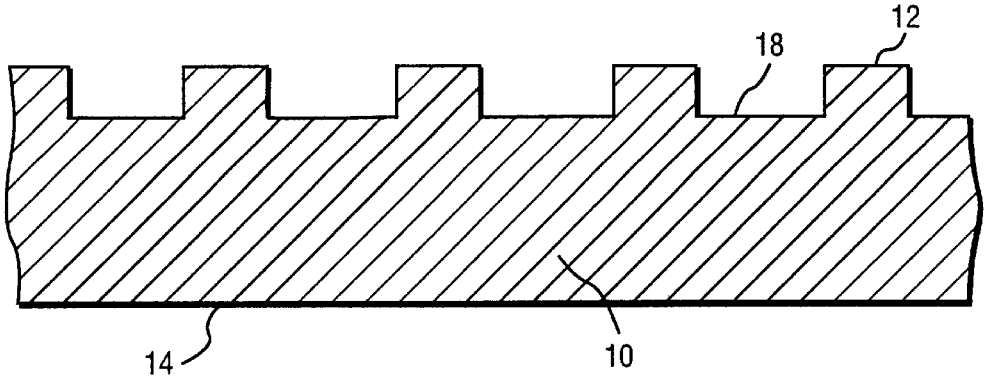
FIG. 1 is a fragmentary cross-sectional view of a casting having cooling enhancement bumps along a surface thereof.

Referring to FIG. 1, there is illustrated a metal casting 10 having a plurality of bumps 12 raised along one side of the casting 10. As an illustrative example, the casting 10 may comprise the wall of a nozzle, bucket or a shroud for a gas turbine. It will be appreciated that in both cases one surface 14 of the casting 10 is exposed to a high-temperature fluid such as hot gases of combustion flowing through a hot gas path. The opposite side contains a series of cast-in, generally hill-like or shaped cooling bumps 12 arrayed along the cooling surface side of the casting to afford enhanced heat transfer. It will be appreciated that the bumps can be formed in many configurations such as semi-spheres, short pins, cylindrical or rectilinear and that the term "bumps" as used herein is not limited to any particular configuration, provided the bumps afford an increased surface area relative to a smooth surface to enhance heat transfer across the casting.

Figure 2:
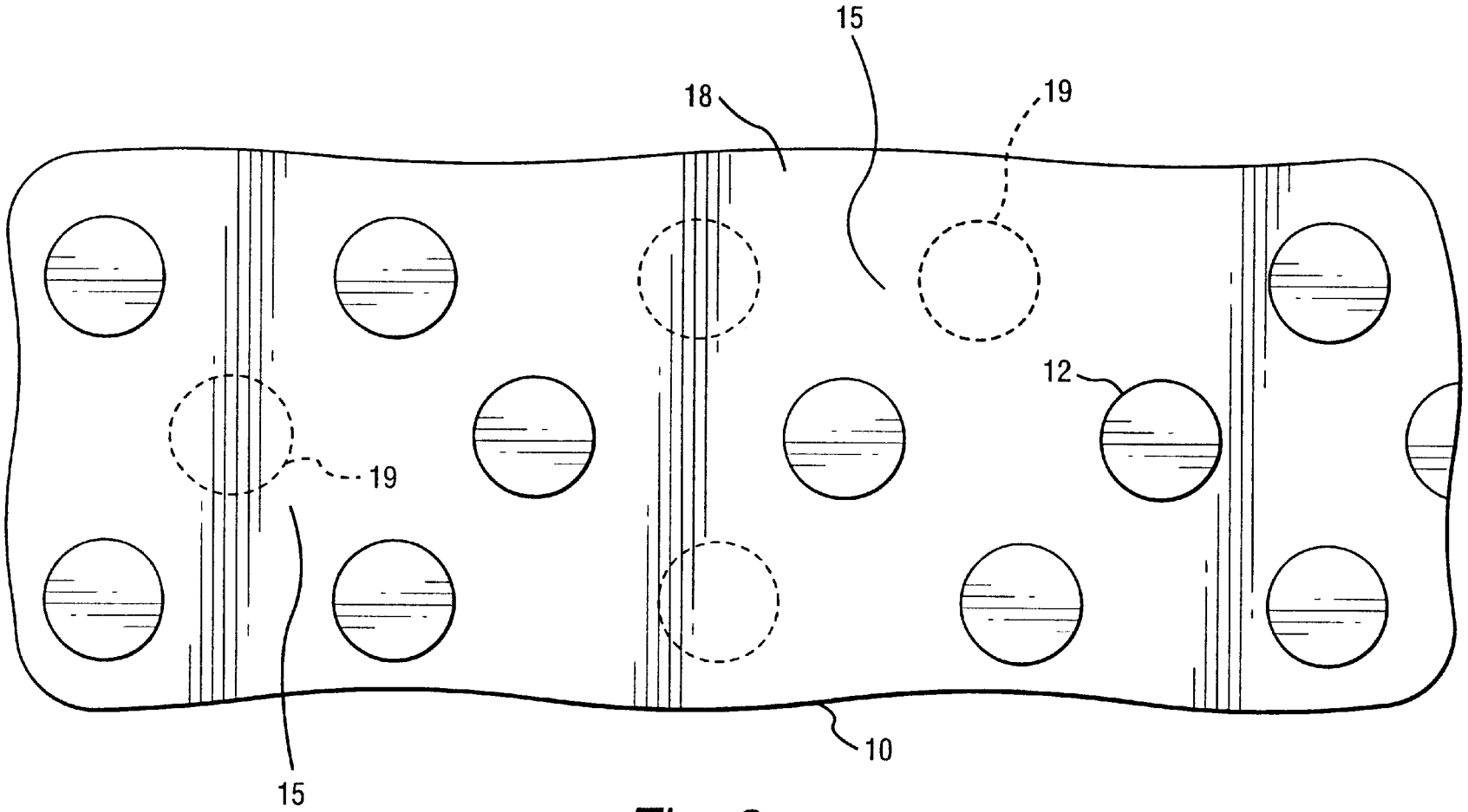
FIG. 2 is a plan view of the surface illustrating an area of defectively cast bumps.

As sometimes occurs, the bumps 12 are defective. That is, the bumps in certain areas, i.e., defectively cast areas 15, along the cooling side surface 18 of the casting 10 are missing or only partially formed during the casting process. For example, as illustrated in FIG. 2, the cooling side surface 18 has a plurality of bumps 12 which are intended to be arranged in a patterned array of rows and columns. From a review of FIG. 2, however, it will be appreciated that certain bumps, e.g., bumps 19, are only partially formed or are missing from the rows of regularly spaced bumps 12. The partially cast bumps may extend only partly to their full height or have irregular configurations, or both. When significant areas of the casting are found to be defectively formed during the casting process, the parts are typically scrapped. In accordance with the present invention, the defectively cast parts are salvaged by thermal spraying a coating of heat transfer enhancement material onto the defective areas to improve the local heat transfer.

To accomplish the foregoing, the defective area or areas of the casting are first identified. This can be done visually. Once identified, the defective area is cleaned, removing some or all of the defective bumps. For example, grinders or grit blasting may be applied to the defective areas, depending upon their accessibility. In nozzles, the openings to the nozzles are sufficiently large to insert a grinding head and thus remove poorly cast bumps or roughen the surface of the area which is defectively clear of bumps. Alternatively, the defectively formed bumps may remain in the defective area after cleaning. Subsequent to cleaning the defective areas, metal particles are applied to the defective locations and bonded on top of those areas or on top of the defective bumps and between the bumps. The application of these particles significantly enhances the heat transfer of the local surface area and, for salvaging parts, they are applied only to the defective area or areas.

Particularly, a high temperature metal coating representative of and selected from a group of coatings based on Fe, Co or Ni, or their combinations, is spray coated by an electric arc spray applicator. Sometimes these coating alloys are referred to as the M—Cr—Al alloys in which the M is Fe, Co, Ni, or their combination. For example, a Ni—Cr—Al—Y type of metallic coating consisting nominally by weight of 12.5% Cr, 10% Al, 1% Y, with the balance Ni is spray coated onto the defective locations. This coating material being metallic inherently has a relatively high coefficient of thermal conductivity as compared with non-metallic materials. In order to attain a heat transfer augmentation of at least about 1.3–1.5 according to a preferred form of the invention, the average coating thickness must be at least about 0.0081" and less than about 0.017". This coating provides a 30–50% improvement in heat transfer. Improvement according to the present invention can be achieved from a coating thickness of about 0.003" for a heat transfer augmentation of about 1.1. In order to attain a heat transfer augmentation of at least about 1.3–1.5 according to a preferred form of the invention, the coating roughness must be greater than about 1180 micro inches Ra up to about 1700 micro inches Ra, where Ra is the average layer or coating surface roughness. However, an augmentation of about 1.1 can be achieved at a coating roughness of about 500 micro inches Ra. According to a preferred form of the present invention, a metallic article surface layer, for example, a coating over the defectively cast area, is provided for augmentation of heat transfer from the turbine component. Such metallic surface layer is characterized by a relatively high heat transfer surface area, and a thickness in the range of about 0.008"–0.017", in combination with an average surface roughness of greater than about 1180 micro inches Ra, and preferably up to about 1700 micro inches Ra.

Figure 3:
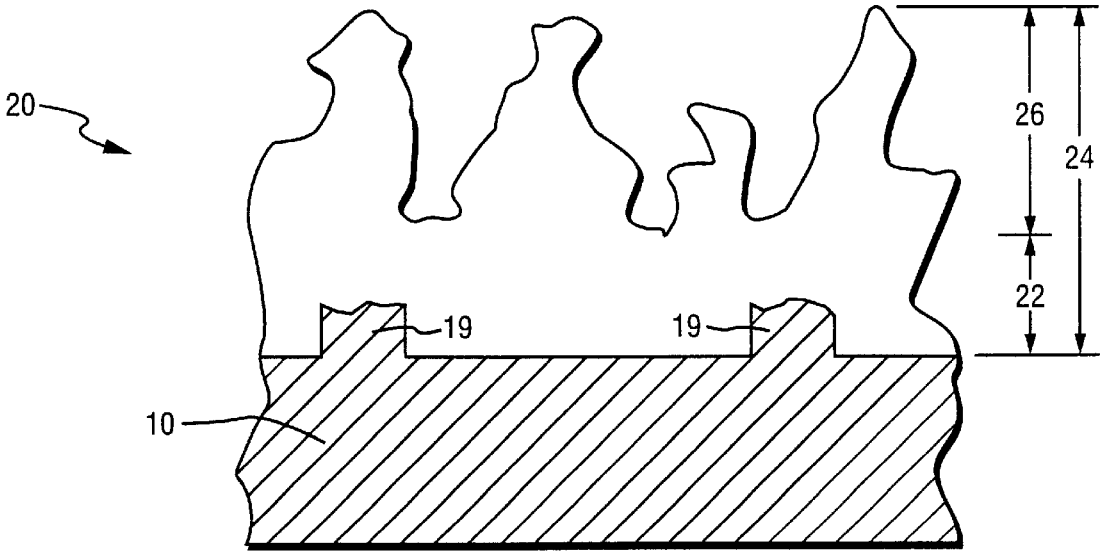
FIG. 3 is a view similar to FIG. 1 illustrating the defective area coated with a cooling enhancement material.

In the fragmentary sectional view of FIG. 3, a metallic surface layer, generally indicated 20, in the form of an electric arc sprayed metal coating of the above-identified Ni—Cr—Al—Y type alloy is deposited on and bonded with the defective area of the element 10. According to a preferred form of the present invention, the layer or coating 22 has a total coating thickness 24 in the range of from about 0.008" up to about 0.017" taken as an average of total thicknesses. Coating 20 has a surface roughness potion 26 of at least about 1180 micro inches Ra, and preferably about 1200–1700 micro inches Ra. The balance of the coating or layer is inner portion 22, which together with roughness portion 26 defines coating thickness 24. As inner portion 22 increases in thickness, it tends to resist transfer of heat from element 10. Therefore, too thick an inner layer is undesirable. With a surface roughness of at least about 500 micro inches Ra, and preferably at least about 1180 micro inches Ra, as defined by the present invention, an increase in the thickness of inner portion 22 overlying the defectively cast area to provide a total layer or coating of a thickness greater than about 0.017" can reduce the rate of heat transfer from the substrate.

To provide the above-described metallic layer according to the present invention, a variety of methods can be used, including known and commercially used thermal spray type processes. One thermal spray type process which has been used and is preferred in connection with the present invention is an electric arc spray process using a metallic wire. Generally in electric arc wire spraying, at least two wires of the same, similar or different materials are melted by an electric arc, atomized into particles and the molten particles are propelled by a high velocity gas stream, such as of an inert or reducing gas or air, onto the defectively cast area to bond with that surface area and to each other in the build up of a surface coating or layer. The process parameters of such a process can be adjusted readily to provide the layer requirements of the present invention.

In one example hereof, the defective areas of the high temperature base superalloy of the turbine component is prepared by grit blasting to enhance surface bonding of molten droplets propelled from an electric arc wire spray process. The metallic wire, in this example to provide the above-described Ni—Cr—Al—Y alloy as a surface layer, comprises a Ni—Cr sheath filled with Ni and Cr particles and with Al and Y powder. The wire is used in a twin wire electric arc spray process in which the wires are held at a spray distance of about 3–4" from the substrate. Other processing parameters include a current of about 150–300 amps at a voltage of about 27–33 d.c. For atomizing the molten wire, an air pressure of about 20–40 psi is used. In this manner, a series of layers or coatings of the Ni—Cr—Al—Y alloy are bonded to the defective cast areas of the turbine component to a total thickness 24 in FIG. 3 in the range of about 0.008–0.17" in combination with a surface roughness 26 in the range of about 1200–1700 micro inches Ra. The tensile bond strength of each layer may be at least about 4 ksi. and generally in the range of about 6–12 ksi.

Electric arc wire spray process parameters may be used within the ranges of about 100–500 amps of electric current, distances between spray gun and substrate of about 2–8", and an air pressure of about 20–80 psi to atomize the molten wire metal and propel droplets toward and into contact with the defectively cast areas. The atomizing air pressure is the only significant variable in order to control the surface layer, with lower air pressure resulting in higher roughness. Therefore, according to one form of the present invention in which the electric arc wire spraying is used to deposit the surface layer, the atomizing air pressure is maintained within the range of about 20–80 psi, and preferably about 20–40 psi at a gun-to-substrate distance of about 3–4".

In accordance with a preferred embodiment of the present invention, the thermally sprayed coating is applied only on the defective areas of the turbine component. The coating may be of the type as previously described, e.g., comprising an alloy and a roughness producing cooling enhancement material. The material in the coating preferably comprises metallic particles bonded to the defective surface areas. With the material and the coating, the surface area ratio, i.e., the surface area with the coating and cooling enhancement material divided by the defective surface area without the material and coating is in excess of the first surface area ratio and affords enhanced heat transfer values. Thus, the local heat transfer enhancement value of the surface coated with the coating and protuberances fused to the surface is greater than the heat transfer value of the defective surface area(s) without the coating. It will be appreciated that the coating may be applied in accordance with any of the techniques described previously.

From the foregoing description, it will be appreciated that the surface areas of parts which have defectively cast-in bumps may be effectively repaired to produce enhanced heat transfer characteristics. The cast parts, which previously contained defective bumps, need not, with the advent of the present invention, be scrapped. Rather, the parts can be salvaged and used without the resulting economic loss.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of salvaging a casting having cast cooling bumps projecting from a surface thereof wherein at least one area of said surface has defectively cast bumps manifested by one or more missing or partially cast bumps, comprising the steps of:

identifying the defectively cast area; and thermally spraying a coating on said defectively cast area to form an overlying coated surface having a coated surface area in excess of the uncoated defective surface area to afford enhanced heat transfer across the casting relative to the heat transfer across the casting without applying the coating.

2. A method according to claim 1 including applying the coating solely to the defectively cast area.

3. A method according to claim 1 wherein the coating is sprayed on said defectively cast area to a thickness of about 0.008 inch to about 0.017 inch.

4. A method according to claim 1 wherein said coating is sprayed on said defectively cast area to provide a surface roughness of greater than about 500 micro inches Ra.

5. A method according to claim 1 including thermally spraying a coating of M—Cr—Al alloy in which M is at least one element selected from the group consisting of Fe, Co, and Ni.

6. A method according to claim 1 including thermally spraying a coating of M—Cr—Al—Y alloy in which M is at least one element selected from the group consisting of Fe, Co, and Ni.

7. A method according to claim 1 including thermally spraying a coating of M—Cr alloy in which M is at least one element selected from the group consisting of Fe, Co, and Ni.

8. A method according to claim 1 wherein the step of spraying includes melting a pair of metal wires in an electric arc to form metallic particles and depositing the particles in a molten state onto the defective cast area to bond with the defectively cast area and with one another.

9. A method according to claim 8 including propelling the molten particles onto the defectively cast area using a high velocity gas stream.

10. A method according to claim 1 including, prior to spraying, cleaning the defectively cast area.

11. A method according to claim 1 wherein the coating is sprayed on said defectively cast area to a thickness of about 0.008 inch to about 0.017 inch, and spraying said coating on said defectively cast area to provide a surface roughness of greater than about 500 micro inches Ra.

12. A method according to claim 11 including spraying said coating on said defectively cast area to provide a surface roughness of about 1200–1700 micro inches Ra.

* * * * *

UNITED STATES PATENT AND TRADEMARK OFFICE

CERTIFICATE OF CORRECTION

PATENT NO. : 6,537,619 B2
APPLICATION NO. : 09/833796
DATED : March 25, 2003
INVENTOR(S) : Johnson et al.

It is certified that error appears in the above-identified patent and that said Letters Patent is hereby corrected as shown below:

In Column 1, immediately below the title, insert:

--The Government of the United States of America has rights in this invention pursuant to Contract No. DE-FC21-95MC31176 awarded by the U. S. Department of Energy.--

Signed and Sealed this

Twentieth Day of February, 2007

JON W. DUDAS
*Director of the United States Patent and Trademark Office*